US006442360B1

(12) United States Patent
Onodera et al.

(10) Patent No.: US 6,442,360 B1
(45) Date of Patent: Aug. 27, 2002

(54) LAMP HOLDER, AND LAMP CARTRIDGE USING THE SAME AND FIXING UNIT USING THE SAME

(75) Inventors: Ken Onodera, Hitachinaka; Sho Sawahata; Shuho Yokokawa, both of Mito; Kunitomo Takahashi, Hitachinaka, all of (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/714,098

(22) Filed: Nov. 17, 2000

(30) Foreign Application Priority Data

Nov. 19, 1999 (JP) ..... 11-328915
Jul. 7, 2000 (JP) ..... 2000-206657

(51) Int. Cl.[7] ..... G03G 15/20

(52) U.S. Cl. ..... 399/122; 219/216; 219/469; 399/320; 399/330

(58) Field of Search ..... 399/122, 320, 399/328, 330; 219/216, 469, 470; 432/60

(56) References Cited

U.S. PATENT DOCUMENTS 4,493,982 A * 1/1985 Romansky ..... 219/469
5,301,000 A * 4/1994 Heigi ..... 219/216 X

FOREIGN PATENT DOCUMENTS

JP 5-504633 7/1993

* cited by examiner

*Primary Examiner*—William J. Royer
(74) *Attorney, Agent, or Firm*—Antonelli, Terry, Stout & Kraus, LLP

(57) ABSTRACT

The work involved in replacing the fixing lamps in a printer is made easy, and the non-operational period of the printer associated with such maintenance work is shortened. A portion of a fixing lamp is formed in a lamp cartridge which includes a first lamp holder for holding one end of the fixing lamp; a second lamp holder for holding the other end of the fixing lamp; and a protective member holding portion for holding a lamp protective member which is attached depending on necessity. The protective member holding portion is arranged around a region where the lamp holding member is placed, and, thereby, all of the plurality of fixing lamps are capable of being attached to and removed from the heating roller as a unit from one end of the heating roller.

6 Claims, 7 Drawing Sheets

LAMP HOLDER, AND LAMP CARTRIDGE USING THE SAME AND FIXING UNIT USING THE SAME

BACKGROUND OF THE INVENTION

The present invention relates to a fixing unit for fixing a toner image onto a print material, and to a lamp holder, a lamp cartridge using the lamp holder and a fixing unit using the lamp holder.

As fixing units of a printer, typical of a laser printer, a copier machine and the like, there is known a fixing unit in which print material holding a toner image is heated and pressed while it is being transferred between a heating roller and a pressing roller to fix the toner image onto the print material. Lamps operating as a heat source are located inside of the heating roller, and in general, the number of the lamps placed inside the heating roller is increased as the printing speed of the printer is increased.

In the use of such a heating roller having a plurality of lamps, when the heating roller is exchanged due to, for example, the expiration of the lifetime of the heating roller, the roller is replaced by a new heating roller by removing the lamps one by one and then removing the heating roller from the fixing unit. Therefore, the amount of work required to detach and attach the lamps from and to the heating roller is in proportion to the number of lamps, and, accordingly, the work efficiency of this maintenance task has been low.

A structure to solve such a problem is proposed, for example, in published Japanese PCT international publication for patent application No.5-504633(1997). According to Japanese PCT international publication for patent application No.5-504633, the disclosed structure is designed such that the lamps can be pulled off from the back side of the fixing unit in a state in which the heating roller remains attached to the fixing unit.

lamp used in a fixing unit of this kind has a long and slender shape with a diameter about 10 mm and a length above 600 mm. In the case of the structure disclosed in Japanese PCT international publication for patent application No.5-504633, because the attaching and removing of the lamps to and from the heating roller is performed in a state in which the lamps are exposed, there has been a problem in that the lamp surface is scratched or the lamps are broken due to contact between the lamps and the edge of the heating roller or between the lamps and other parts, when the lamps are being attached to or removed from the heating roller.

SUMMARY OF THE INVENTION

An object of the present invention is to make the work of replacing the fixing lamps easy and to shorten the non-operational time period of the printer associated with the maintenance work.

Further, another object of the present invention is to hold the fixing lamps attached inside the heating roller in a correct position without displacement in the heating roller.

The above object can be attained by a fixing unit comprising a heating roller having a plurality of fixing lamps inside; and a pressing roller arranged so as to be capable of pressing against the heating roller, a print material having a toner image being transferred between said heating roller and the pressing roller to fix the toner image onto the print material, wherein the fixing lamps are formed as a lamp cartridge which comprises a first lamp holder for holding one end of the fixing lamps; a second lamp holder for holding the other end of the fixing lamps; and a protective member holding portion for holding a lamp protective member which is attached to the heating roller depending on necessity. The protective member holding portion is arranged around a region where the lamp holding member is placed, whereby all of the plurality of fixing lamps are capable of being attached to and removed from the heating roller together from one end of the heating roller.

DESCRIPTION OF THE PREFERRED EMBODIMENTS

Embodiments in accordance with the present invention will be described below with reference to the accompanying drawings.

Initially, as an example of a printer to which the present invention is applied, a laser beam printer using electrophotography will be described with reference to FIG. 8.

Figure 8:
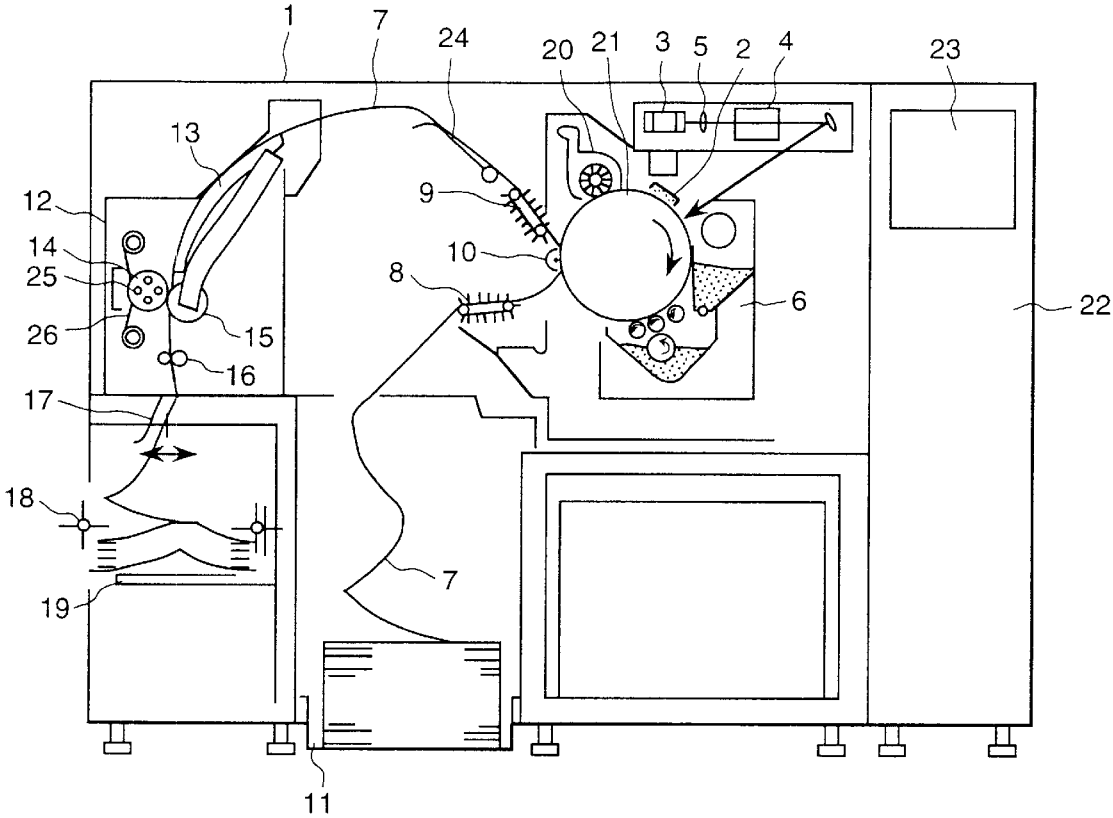
FIG. 8 is a diagrammatic view showing the overall construction of a printer.
Figure 11:
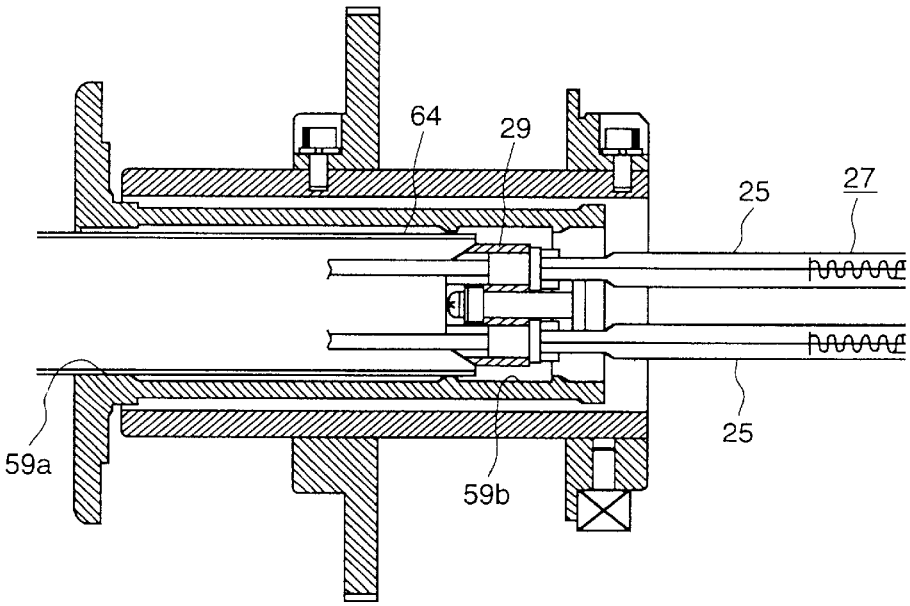
FIG. 11 is a cross-sectional view showing the main portion of the heating roller in the state that a lamp protective member is inserted into the heating roller.

In FIG. 8, the reference character 1 is the laser beam printer, in which a photosensitive drum 21 is rotated in the direction shown by an arrow based on a print operation start signal from a controller 22. The photosensitive drum 21 is rotated at a speed corresponding to a printing speed of the laser beam printer 1 and continues to be rotated until the print operation is completed. As rotation of the photosensitive drum 21 is started, a high voltage is applied to a corona charger 2 to uniformly charge the surface of the photosensitive drum 21, for example, with positive charges.

A rotating polygon mirror 3 starts to rotate immediately after the switching on of the power to the laser beam printer 1, and it is rotated at a constant speed with a high accuracy while the power is supplied. A light beam emitted from a light source 4, such as a semiconductor laser, is reflected by the rotating polygon mirror 3, which operates to irradiate and scan the beam on the surface of the photosensitive drum 21, after the beam has passed through an fθ lens 5.

As character data and pattern data converted into dot images are transmitted to the laser beam printer from the controller 22 as ON/OFF signals of the laser beam, portions irradiated by the laser beam and portions not irradiated by the laser beam are formed on the surface of the photosensitive drum 21 to form a so-called electrostatic latent image. When the area of the photosensitive drum holding the electrostatic latent image arrives at a position opposite to a developing unit 6, toner is supplied onto the electrostatic latent image, and a toner image is formed on the surface of the photosensitive drum 21 by attracting the toner charged with, for example, positive charges to the positions on the surface of the photosensitive drum 21 where charges are eliminated by the irradiation of the laser beam.

A continuous paper sheet 7 contained in a paper hopper 11 is transported by a paper transport tractor 8 toward a gap between the photosensitive drum 21 and a transfer unit 10 in synchronism with a timing at which the toner image of the print data formed on the surface of the photosensitive drum 21 arrives at the transfer position.

The toner image formed on the surface of the photosensitive drum 21 is attracted to the paper sheet 7 by the operation of the transfer unit 10 applying charges having a polarity inverse to the polarity of charges of the toner image on the rear surface side of the paper sheet 7.

As described above, the paper sheet 7 set in the paper hopper 11 is transported to a fixing unit 12 through the paper transport tractor 8, the transfer unit 10, a paper transport tractor 9 and a buffer plate 24. The paper sheet 7 arriving at the fixing unit 12 is pre-heated by a per-heater 13, and then driven between and transported by a nip portion constructed of a pair of fixing rollers composed of a heating roller 14 having a fixing lamp (hereinafter, referred to as "heater lamp") and a pressing roller 15, so that it is heated and pressed by the nip portion to melt-fix the toner image onto the paper sheet 7.

The paper sheet 7 delivered by the heating roller 14 and the pressing roller 15 is dispensed to a stacker table 19 by a paper conveying roller 16, and, alternatively, it is folded along the tear-off edge by a swinging operation of a swing fin 17, and further the folding state of the paper sheet is prepared by rotating paddle 18 and stacked on the stacker table 19. The area of the surface of the photosensitive drum 21 which has passed through the transfer position is cleaned by a cleaning unit 20 so as to be prepared for the next print operation.

In FIG. 8, the reference character 23 denotes a display screen for displaying information based on the state of the laser beam printer 1 during the print operation. The buffer plate 24 described above is used for absorbing the slack or the tension caused in the paper sheet 7 when a difference in the paper transporting speed occurs between the paper transport tractor 9 and the fixing rollers 14, 15. The reference character 26 indicates a web member for cleaning the surface of the heating roller 14 and for applying an erasing agent onto the surface of the heating roller 14, and the web member 26 is arranged so that it may contact the surface of the heating roller 14 and may be wound.

Figure 1:
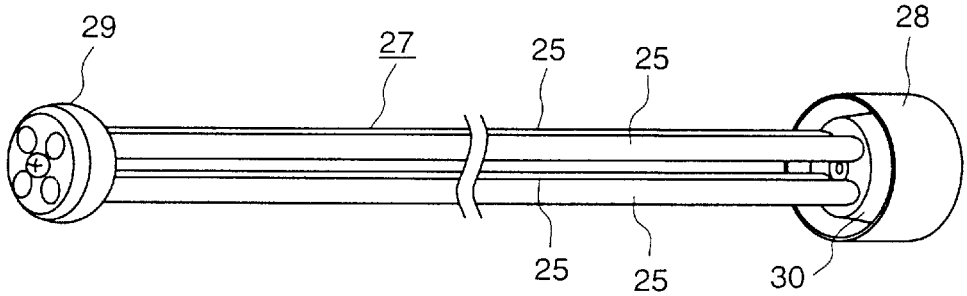
FIG. 1 is a perspective view showing the overall structure of an embodiment of a lamp cartridge in accordance with the present invention.

Referring to FIG. 1, the structure of the lamp cartridge which comprises the present invention will be described in detail below.

The lamp cartridge 27 is composed of a plurality of heater lamps 25 (four heater lamps in the present embodiment) of the type described with reference to FIG. 8, a first lamp holder 28 for holding one end of each of the heater lamps 25, a second lamp holder 29 for holding the other end of each of the heater lamps 25, and a protective member holding portion 30 arranged around the heater lamps 25 held by the first lamp holder 28. The protective member holding portion 30 is provided for holding a lamp protective member, to be described later, when the protective member is attached, and the protective member holding portion 30 in the present embodiment is formed of a tapered surface, though the invention is not limited particularly to this structure.

Figure 2:
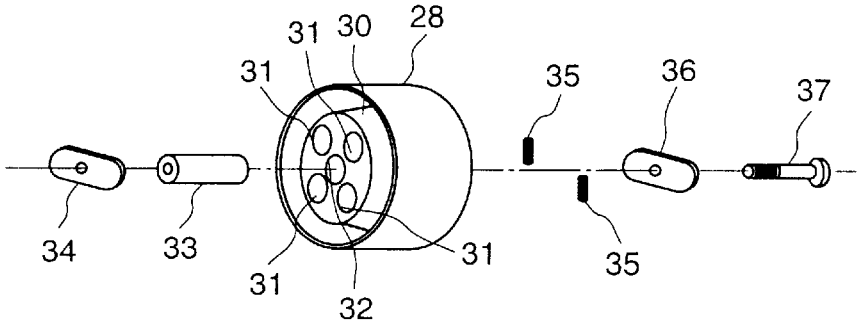
FIG. 2 is an exploded perspective view showing a first embodiment of a lamp cartridge in accordance with the present invention.

As shown in FIG. 2, the first lamp holder 28 comprises holes 31, into each of which one end of a heater lamp 25 is inserted; and a hole 32 for inserting a spacer 33 thereinto. All the holes 31 and the hole 32 are through-holes. Accordingly, when a heater lamp 25 is inserted into the hole 31, a power supply wire provided for each of the heater lamps can be led to the outside through the hole 31 (refer to FIG. 5). The spacer 33 is fit into the hole 32.

The heater lamps 25 are inserted into the holes 31, and then the parts are fixed with a screw 37 by fastening the lamp holder 28 between a plate 34 and a plate 36. In FIG. 2, the reference character 35 indicates springs. The springs 35 are placed in a groove formed in the rear side of the lamp holder 28 so that backlash and play of the heater lamps in the holes 31 are prevented by applying a pushing force between the two heater lamps in opposite directions to each other.

Figure 4:
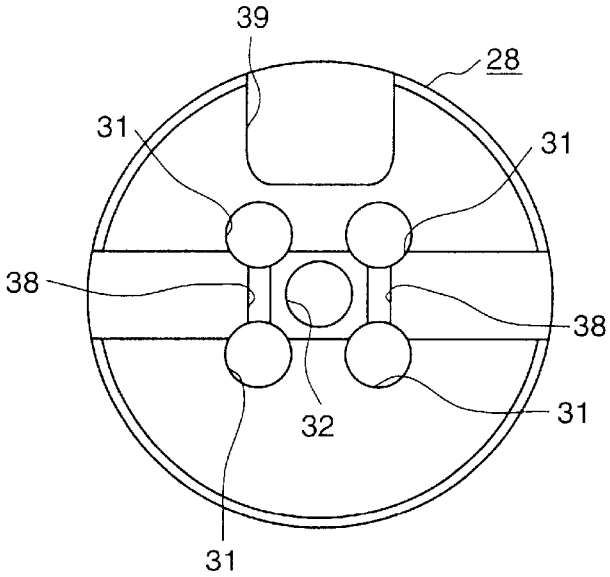
FIG. 4 is a rear view showing the first embodiment of the lamp cartridge.

FIG. 4 shows the rear portion of the lamp holder 28 (a front view showing the lamp holder from the direction of the screw 37 in FIG. 2). In FIG. 4, the reference character 38 indicates the grooves for accommodating the springs 35. The reference character 39 denotes a depressed portion formed in the front surface portion of the lamp holder 28. The depressed portion 39 is provided in order to prevent the lamp cartridge attached to the heating roller from being turned. The position of the lamp cartridge 27 is restricted by fitting a stopping member 65 (refer to FIG. 9 and FIG. 10) arranged in the main body of the fixing unit into the depressed portion 39, and the restriction of the circumferential position of the lamp cartridge 27 is released by drawing back the stopping member 65 from the depressed portion 39.

Figure 3:
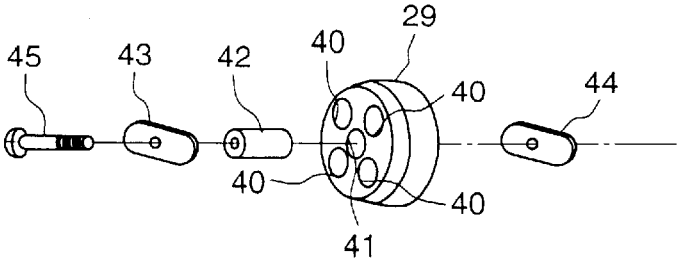
FIG. 3 is an exploded perspective view showing a second embodiment of a lamp cartridge in accordance with the present invention.

On the other hand, as shown in FIG. 3, the second lamp holder 29 comprises holes 40, into each of which the other end of a heater lamp 25 is inserted; and a hole 41 for inserting a spacer 42 thereinto. All the holes 31 and the hole 32 are through-holes similar to the first lamp holder 28. Accordingly, when a heater lamp 25 is inserted into the hole 40, a power supply wire 63 (refer to FIG. 5 and FIG. 9) provided for each of the heater lamps can be led to the outside through the hole 40. The spacer 42 is fit into the hole 41.

The heater lamps 25 are inserted into the holes 40, and then the parts are fixed with a screw 45 by fastening the second lamp holder 29 between a plate 43 and a plate 44. The second lamp holder 29 may be provided with springs similar to the first lamp holder 28, if necessary.

Figure 5:
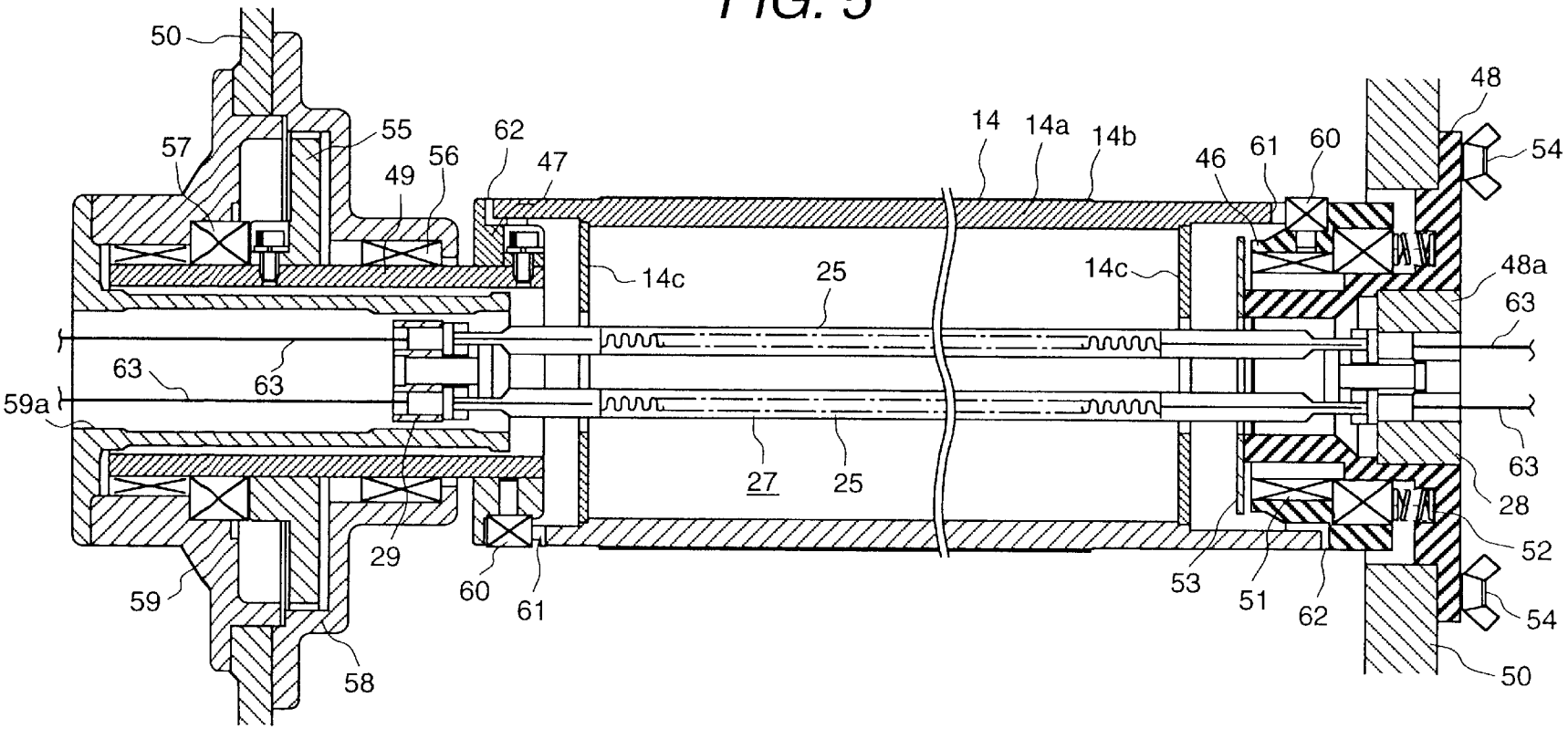
FIG. 5 is a cross-sectional view showing an embodiment of a heating roller.

Referring to FIG. 5, the construction around the heating roller in the state of mounting of the lamp cartridge will be described below.

The heating roller 14 is composed of a metallic base pipe 14*a* made of, for example, aluminum, and a surface layer 14*b* made of Teflon, silicon rubber or the like provided on the base pipe 14*a*, and absorbers 14*c* for preventing heat dissipation are arranged in the inner end portions of the base pipe 14*a*. Both ends of the base pipe 14*a* are supported on a frame 50 of the fixing unit through holding members 48, 49 having centering members 46, 47, respectively.

A bearing 51 is arranged in the holding member 48, and the bearing 51 is coupled with the heating roller 14 along with the centering member 46. Further, the bearing 51 is disposed so that the thermal expansion of the heating roller 14 and deviations in dimensions of the surrounding supporting members can be absorbed using a plurality of springs 52 and a guide plate 53. The holding member 48 is fixed to the frame 50 using wing screws 54. On the other hand, a gear 55 for receiving a drive force from a drive motor (not shown) for driving the heating roller 14 is arranged in the holding member 49, and the gear 55 is supported by two housings 58, 59 containing bearings 56, 57.

A projection 60 is provided in each of the centering members 46, 47 in order to secure coupling with the heating roller 14, and each projection 60 is engaged with one of the grooves 61 provided at both ends of the heating roller 14.

Further, in order to prevent heat from flowing out from the heating roller 14 to the centering members 46, 47 and to prevent damage in the engaging portion of the projection 60 and the groove 61, collars 62 made of a heat resistant plastic are inserted between both end portions of the heating roller 14 and the centering members 46, 47. In FIG. 5, the lines led out from both end portions of the lamp cartridge 27, indicated by the reference characters 63, are the power supply wires of the heater lamps 25.

In the construction described above, the lamp cartridge 27 is inserted through a hole 48*a* formed in the holding member 48 and is attached inside the heating roller 14, as shown in FIG. 5. The reason why the shape of the first lamp holder 28 is different from the shape of the second lamp holder 29 is to prevent erroneous insertion of the lamp cartridge 27.

Figure 6:
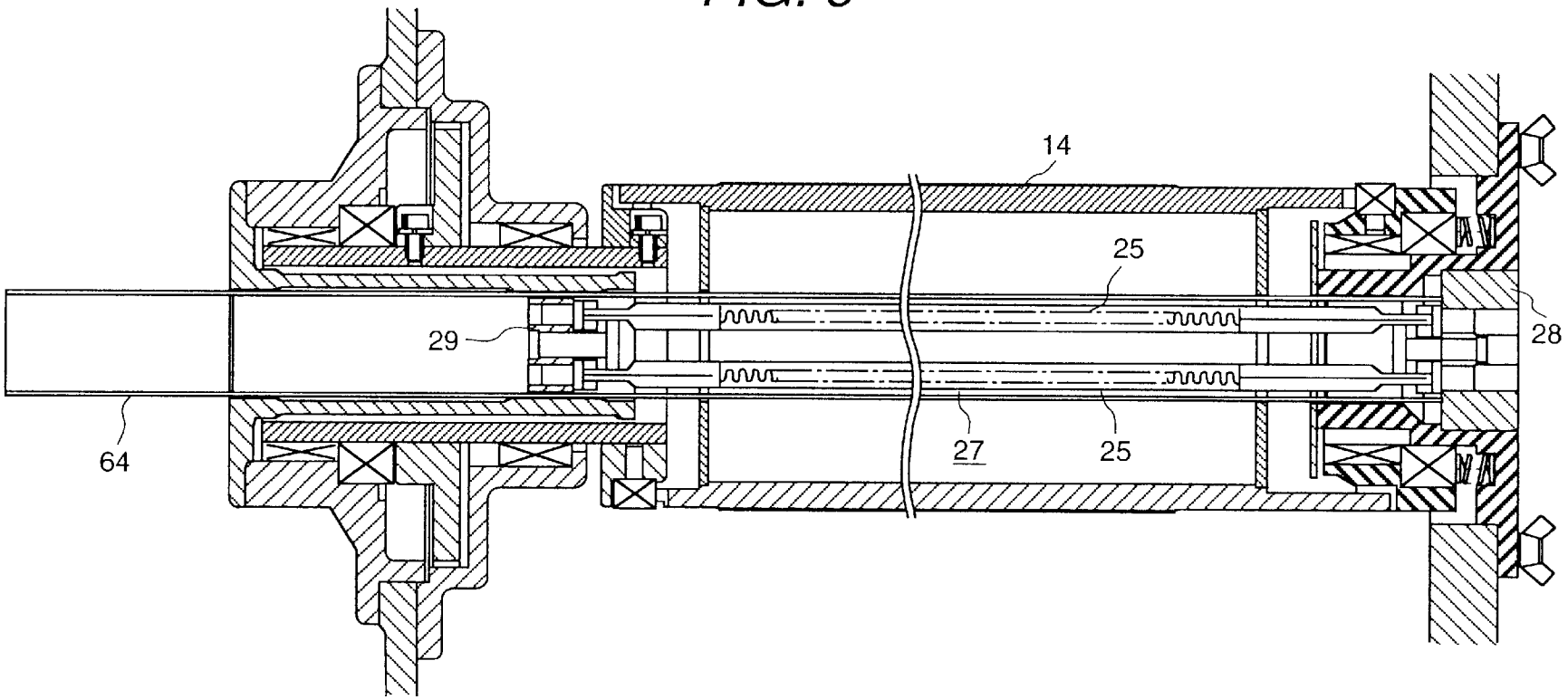
FIG. 6 is a cross-sectional view showing the heating roller in a state in which a lamp protective member is inserted into the heating roller.

When the lamp cartridge 27 is to be pulled out of the heating roller 14, an operator comes to the rear side (the side where the second lamp holder 29 exists) of the printer and inserts a cylindrical member 64 of a lamp protective member through a through hole 59*a* formed in the housing 59, as shown in FIG. 6. Then the operator pushes in the cylindrical member 64 until the inner front end peripheral surface of the cylindrical member 64 is held by the tapered surface 30 provided in the first lamp holder 28.

After the setting of the cylindrical member 64 is completed, the operator moves to the front side of the printer and draws back the stopping member described above from the depressed portion 39 of the first lamp holder 28 to release the positional restriction of the lamp cartridge 27.

Figure 7:
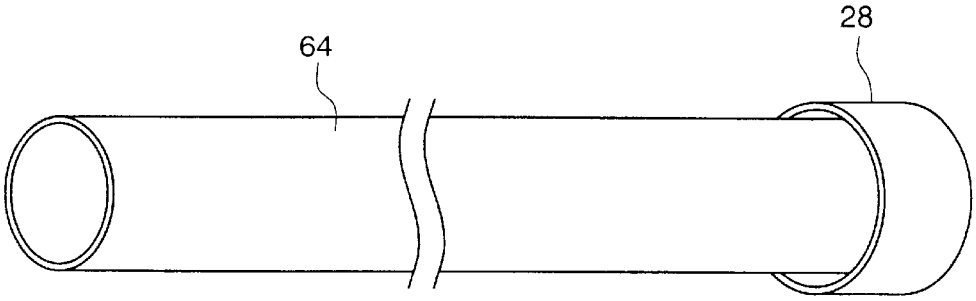
FIG. 7 is a perspective view showing the overall structure of the lamp cartridge over which the lamp protective member is attached.

As the lamp cartridge 27 in this state is drawn out, the lamp cartridge 27 and the cylindrical member 64 are drawn out together and removed to the outside in the state as shown in FIG. 7.

Further, when the lamp cartridge 27 is inserted into the heating roller 14, the lamp cartridge 27 in the state as shown in FIG. 7 is loaded from the front side of the printer, and the stopping member 65 is moved on the depressed portion 39 of the first lamp holder 28 to restrict the position of the lamp cartridge 27. After that, the operator comes to the rear side of the printer and draws off the cylindrical member 64, so that only the lamp cartridge 27 remains inside the heater roller to complete the work of attaching the lamp cartridge 27.

Figure 9:
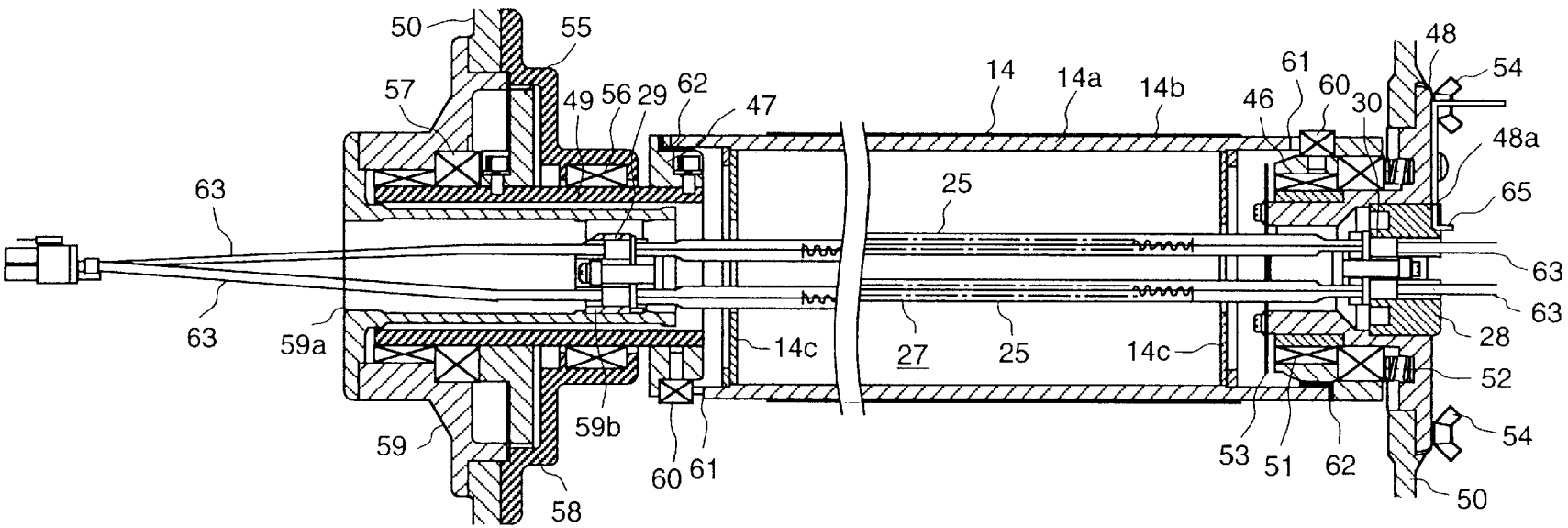
FIG. 9 is a cross-sectional view showing another embodiment of a heating roller.
Figure 10:
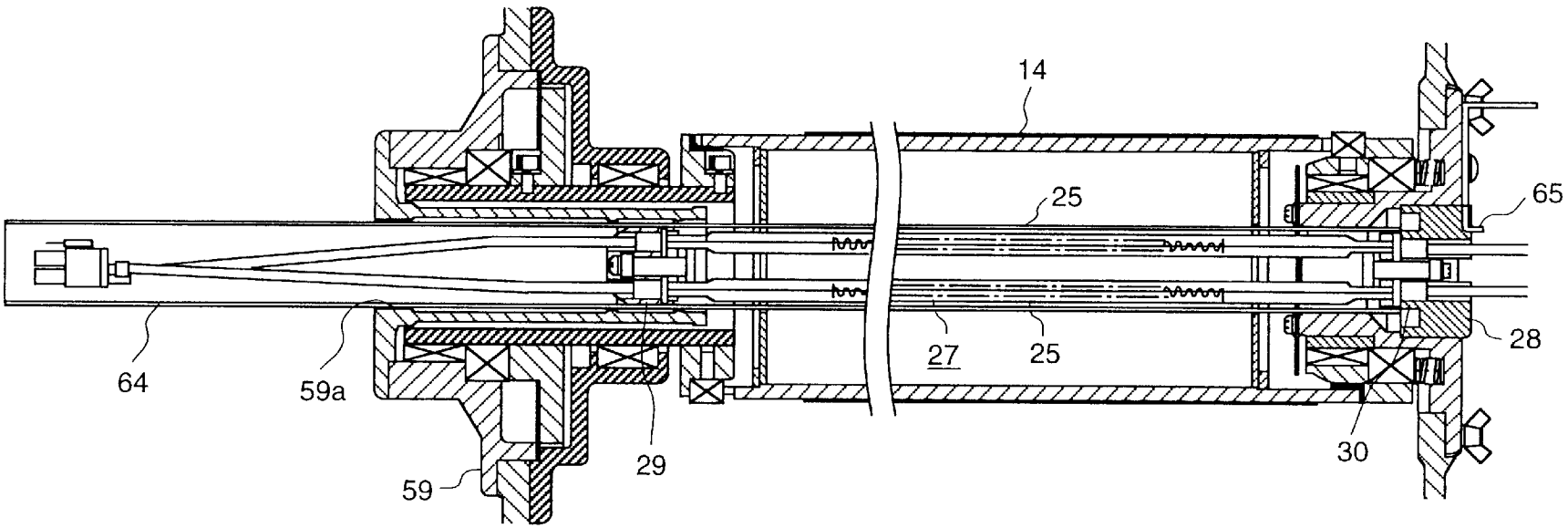
FIG. 10 is a cross-sectional view showing the heating roller in a state in which a lamp protective member is inserted into the heating roller.

FIG. 9 and FIG. 10 show a more practically preferable embodiment having a construction obtained by modifying the above-mentioned construction. Here, the key difference is that the second lamp holder 29 as part of the lamp cartridge 27 engages in a depressed portion 59*b* provided in the inner peripheral portion of a through hole 59*a* of the housing 59. The depressed portion 59*b* forms the lamp holder means in the present invention, and the lamp cartridge 27 is restricted in its movement in the axial direction as the second lamp holder 29 becomes engaged in the depressed portion 59*b*.

In the case of the construction shown in FIG. 9 and FIG. 10, when the lamp cartridge 27 is to be pulled out of the heating roller 14, an operator comes to the rear side (the side where the second lamp holder 29 exists) of the printer and inserts a cylindrical member 64, which serves as a lamp protective member, through a through hole 59*a* formed in a housing 59, as shown in FIG. 10. The operator then pushes in the cylindrical member 64 until the inner front end peripheral surface of the cylindrical member 64 is held by the tapered surface 30 provided in the first lamp holder 28.

As the cylindrical member 64 is inserted in the state described above, the front end of the cylindrical member 64 picks up the second lamp holder 29 and disengages it from the depressed portion 59*b*, so as to release the positional restriction of the lamp cartridge 27 against movement in the axial direction caused by the depressed portion 59*b*.

As described above, according to the present invention, since the fixing lamps are protected by the lamp protective member when the fixing lamps are attached to and removed from the heating roller, the attaching and removing of the fixing lamps can be performed efficiently and safely.

Further, since the fixing lamps attached inside the heating roller are held at the correct position inside the heating roller without displacement, the range of the heating region in the axial direction of the heating roller becomes stable, and, accordingly, any fixing deficiency caused by over heating or insufficient heating can be reduced.

What is claimed is:

1. A lamp holder for holding a plurality of fixing lamps, comprising:

a plurality of lamp holding portions, each of said lamp holding portions holding one end of each fixing lamp; and a protective member holding portion for holding a lamp protective member which is attached depending on necessity, said protective member holding portion being arranged around a region where said lamp holding portion is placed.

2. A lamp cartridge comprising:

a plurality of fixing lamps;

a first lamp holder for holding one ends of said fixing lamps;

a second lamp holder for holding the other ends of said fixing lamps; and a protective member holding portion for holding a lamp protective member which is attached depending on necessity, said protective member holding portion being arranged around a region where at least one of said first and second lamp holders is placed.

3. A fixing unit comprising a heating roller having a plurality of fixing lamps inside; a and a pressing roller arranged so as to be capable of pressing against said heating roller, a print material having a toner image being transferred by being put between said heating roller and said pressing roller for fixing said toner image onto said print material, wherein a portion of said fixing lamps are formed in a lamp cartridge which comprises a first lamp holder for holding one end of said fixing lamps; a second lamp holder for holding the other end of said fixing lamps; and a protective member holding portion for holding a lamp protective member attached depending on necessity, said protective member holding portion being arranged around a region where at least one of said first and second lamp holders is placed, and thereby all of said plurality of fixing lamps are capable of being attached to and detached from said heating roller together from one end side of said heating roller.

4. A fixing unit comprising a heating roller having a fixing lamp inside; and a pressing roller arranged so as to be capable of pressing against said heating roller, a print material having a toner image being transferred by putting between said heating roller and said pressing roller for fixing said toner image onto said print material, wherein a portion of said fixing lamp is formed in a lamp cartridge which comprises a first lamp holder for holding one end of said fixing lamp; a second lamp holder for holding the other end of said fixing lamp; and a protective member holding portion for holding a lamp protective member attached depending on necessity, said protective member holding portion being arranged around a region where at least one of said first and second lamp holders is placed, and said lamp cartridge is capable of being attached to and detached from said heating roller together from one end side of said heating roller, and a lamp holder restricting means for restricting motion of said lamp cartridge in an axial direction by engaging said lamp cartridge with said second lamp holder in a state that said lamp cartridge is attached to said heating roller.

5. A fixing unit according to claim 4, wherein restriction of the second lamp holder by said lamp holder restricting means is released by inserting said lamp protective member from a side of the second lamp holder.

6. A fixing unit according to claim 4, wherein a plurality of fixing lamps are held between said first lamp holder and said second lamp holder.

* * * * *